United States Patent [19]

Barish et al.

[11] Patent Number: 4,601,616

[45] Date of Patent: Jul. 22, 1986

[54] ROOF SUPPORT SYSTEM FOR A MINE AND THE METHOD AND TOOLING FOR PROVIDING THE SAME

[75] Inventors: Ken Barish, Indiana; Paul Yacisin, Patton, both of Pa.

[73] Assignee: Jennmar Corporation, Pittsburgh, Pa.

[21] Appl. No.: 711,303

[22] Filed: Mar. 13, 1985

[51] Int. Cl.[4] ..... E21D 20/00; E21D 21/00

[52] U.S. Cl. ..... 405/288; 405/259

[58] Field of Search ..... 405/259, 260, 261, 262, 405/258, 303; 81/57.11, 55, 57.13, 57.14

[56] References Cited

U.S. PATENT DOCUMENTS

| | | | |
|---|---|---|---|
| 2,667,037 | 1/1954 | Thomas et al. | 405/259 |
| 3,427,811 | 2/1969 | White | 405/259 |
| 3,505,824 | 2/1969 | White | 405/259 |
| 3,509,726 | 6/1969 | White | 405/259 |
| 4,274,762 | 6/1981 | Johnson | 405/259 |
| 4,349,300 | 9/1982 | Kelley | 405/288 |
| 4,395,161 | 7/1983 | Wilson et al. | 405/259 |
| 4,498,816 | 2/1985 | Korpela et al. | 405/259 |

OTHER PUBLICATIONS

Mine Controls Bad Roof with Trusses Bolted on Cycle, by Ken Barish, Coal Age 5/85, pp. 62–66.

Current Trends in Roof Truss Hardware, by C. P. Manglesdorf.

Hydraulic Tensioning of a Birmingham Roof Truss, by C. W. Bollier.

*Primary Examiner*—Dennis L. Taylor

*Attorney, Agent, or Firm*—Stanley J. Price, Jr.

[57] ABSTRACT

An improved roof support system for a mine or the like is of the type which includes a pair of plates secured to the roof of the mine at opposite sides thereof adjacent opposing ribs of the mine and a horizontal, transverse reinforcing member extending between the pair of plates. The improvement includes the reinforcing member having a first rod with a first end thereof secured to a first of the plates and a second end extending toward the second plate. The second plate includes a vertical portion with a transversely extending opening therethrough. The reinforcing member also includes a second rod in the form of a bolt which has a bolt head located against the vertical portion of the second plate with the threaded second end thereof extending through the opening toward the first plate. The second end of the first rod includes a sleeve mounted thereon having a threaded bore therethrough for receipt of the threaded end of the bolt. The bolt and the first rod are coupled together by insertion of the threaded end of the bolt into the threaded bore to form the reinforcing member. The reinforcing member is capable of producing tension between the first and second plate which tension may be varied by rotation of the bolt head of the bolt relative to the first rod. The invention also includes the method of supporting the roof of a mine and a tool for providing the same.

14 Claims, 7 Drawing Figures

ROOF SUPPORT SYSTEM FOR A MINE AND THE METHOD AND TOOLING FOR PROVIDING THE SAME

BACKGROUND OF THE INVENTION

1. Field of the Invention

This invention relates to an improved roof support system for a mine or the like, and more specifically, to such a roof support system which utilizes a horizontal, transverse reinforcing member which is simple to provide and conveniently utilized to produce a desired tension between a pair of roof plates of the roof support system.

2. Description of the Prior Art

Although there are numerous methods for supporting the roof of mines, openings, or the like, one type which is commonly employed includes a roof truss structure which generally includes two inclined cords and a horizontal cord. The inclined cords are usually mine roof bolts or the like which extend into holes in the mine roof at about a 45° angle. The mine roof bolts may be anchored in the inclined holes in the roof by well known means such as expansion shells and/or resin bonding. The horizontal cord or tie member extends transversely across the roof the mine between the terminal ends of the inclined cords located at the surface of the roof. Providing means for applying tension to the anchored, inclined cords and the horizontal cords can result in sufficient upward force being generated on the roof to allow safe operation in the mine or the like while preventing uncontrolled vertical downward movement of the roof or any other creeping movement thereof which might cause it to become unstable.

U.S. Pat. No. 2,667,037 disclosed a general roof support system which basically provides the type of upward forces described hereinabove. Specifically, a horizontal beam or the like was positioned transversely of the mine opening across the roof and was retained in place by a plurality of inclined bolts which anchored the horizontal beam and provided overall integrity for roof support.

U.S. Pat. No. 3,427,811 disclosed a system which provided for the same type of upward forces to support a mine roof but included the additional feature of a means for varying the tension on the horizontal cord and reportedly resulted in an overall system which exerted at least approximately equal tension on the horizontal cord and the inclined anchoring cords. Although U.S. Pat. No. 3,505,824, and 3,509,726 disclose roof support trusses or systems which function generally like that mentioned hereinabove, they employ different elements to create a combined tension on the inclined cord and horizontal cord components.

The roof support system generally disclosed in U.S. Pat. No. 4,395,161 results in a similar configuration but includes features for ease of installation and adjustability which may exist in the prior art devices mentioned hereinabove but are not as clearly demonstrated. Specifically, the device includes a pair of transition plates to be installed in the roof of the mine by inclined cords in the form of mine roof bolts which can be separately installed and adjusted to provide the desired tension thereto. Subsequently, the same or a different mining crew is then capable of installing a horizontal, transversely extending reinforcing member to provide the horizontal cord component of the mine roof truss. In the case of U.S. Pat. No. 4,395,161, the reinforcing member is disclosed to preferably be an elongated rod having threaded ends with adjusting nuts installed at each of the ends to produce tension between the transition plates.

When trying to determine which truss system or other roof support system should be utilized, there are some mine operating conditions and safety requirements which should be taken into consideration. A more attractive roof support system would be one which could reduce installation time to mining cycle time, included a means to provide uniform truss tensioning during installation with a capability to vary tensioning depending upon roof conditions and would improve the overall work conditions. These objectives were founded on the need to increase the effectiveness of the truss in roof support and reduce the cost of roof control. It is well known that roof control effectiveness can be enhanced by quickly supporting the roof after coal extraction. By installing the truss in the mining cycle, the time that the roof remains unsupported by the truss is decreased. By tensioning uniformly, a way is open for the truss to become the primary roof control method, thus reducing the requirement in many cases for roof bolting and trussing in the same location.

Further, it has been found that proper truss tensioning improves system effectiveness. Using a pipewrench as a tensioning tool has shown considerable variability in truss tensioning during installation and tensioning is dependent upon the size and strength of the operator and the time of day in which the truss is installed. For example, early in a work shift, trusses are usually installed with proper tensioning, but as the day wears on the quality of workmanship declines as in many other industries.

Truss tensioning is an unpopular task because conditions in some mining areas create an unnatural strenuous working position for the individual actually tensioning the truss. To gain a greater acceptance of this operation, any improvement in such a system which could reduce the installation time, reduce the strenuous nature of the work and eliminate the potential for straintype of injuries would be desirable.

Accordingly, while the device shown in U.S. Pat. No. 4,395,161 incorporates separate installation of a roof plate with a separately adjustable inclined mine roof bolt, any improvement to the horizontal, transversely extending reinforcing member would be desirable. Further, it would clearly be an advantage if a more simplified means were available for installing such a horizontal, transverse reinforcing member which method also facilitated the use of power tools for creating the desired tension between the roof plates.

SUMMARY OF THE INVENTION

In accordance with the present invention, there is provided an improved roof support system for a mine or the like of the type which includes a pair of plates secured to a roof of the mine at opposite sides thereof adjacent opposing ribs of the mine and a horizontal, transverse reinforcing member extending between the pair of plates. The improvement includes the reinforcing member including a first rod means having a first end secured to a first of the pair of plates and a second end extending toward a second of the pair of plates. The second plate has a vertical portion thereof with a transversely extending opening therethrough. The reinforcing member includes a second rod means having a first end including an enlarged head with a torque applying surface thereon. The first end is located against the vertical portion of the second plate as the second rod means extends through the opening with a second end thereof extending toward the first plate. The second ends of the first and the second rod means includes mating threaded means thereon for coupling the first and the second rod means together to form the reinforcing member which is capable of producing tension between the first and second plates which tension may be varied by rotation of the enlarged head of the second rod means relative to the first rod means.

Further in accordance with the present invention there is provided a method of supporting a roof of a mine of the like including the initial step of securing a pair of roof supporting plates at opposite sides of the roof adjacent opposing ribs of the mine. Each of the plates has a vertically extending force bearing surface thereon. A first rod means having securing means at the first end thereof and a threaded coupling at a second end thereof is provided. There is provided a second rod means having an enlarged head portion with torque applying surfaces thereon at a first end thereof and a threaded region at a second end thereof which is capable of being threadably mated with the threaded coupling of the first rod means. The first rod means is installed with the securing means of the first end against the force bearing surface of a first of the pair of plates and a second end extending toward a second of the pair of plates. The second rod means is installed with the enlarged head portion against the force bearing surface of the second plate as the threaded region of the second end thereof is threadably engaged with the threaded coupling of the first rod means. Tension is produced between the first and the second plates by rotating the enlarged head portion of the second rod means relative to the first rod means to increase the engagement of the threaded region of the second end of the second rod means with the threaded coupling of the first rod means.

Still further in accordance with the present invention there is provided a tool for producing tension between a pair of plates secured to a roof of a mine or the like. The pair of plates are located at opposite sides of the roof adjacent opposing ribs of the mine and have a horizontal, transverse reinforcing member extending therebetween. The reinforcing member has a first end and a second end threadably joined to allow relative rotation therebetween to vary an overall length of the reinforcing member. The first end is nonrotatably secured to the first of a pair of the plates and the second end includes an enlarged head abutting a force bearing surface of the second of a pair of the plates on a side thereof toward a rib of the mine adjacent the second plate. The tool includes a source of power an means for converting the source of power to a rotating, torque applying output element. An output fitting on the torque applying output element is capable of mating with the enlarged head of the second end of the reinforcing member to produce rotation thereof. A stablizing means extends between the means for converting and the second plate to prevent relative rotation thereof during rotation of the enlarged head by the output fitting of the output element.

Consequently, it is a primary object of the invention to provide an improved roof support system which is relatively inexpensive to provide and can be simply and conveniently installed and adjusted.

It is another object to provide a method for installing such an improved roof support system.

Still another object of the invention is to provide a tool which can be readily employed with such an improved roof support system which will reduce the time required for installing a horizontal, transverse reinforcing member and provide better control for the eventual tension supplied thereby between a pair of roof plates.

These and other objects of the present invention will be more completely disclosed and described in the following specification, the accompanying drawings and the appended claims.

DESCRIPTION OF THE PREFERRED EMBODIMENTS

Figure 1:
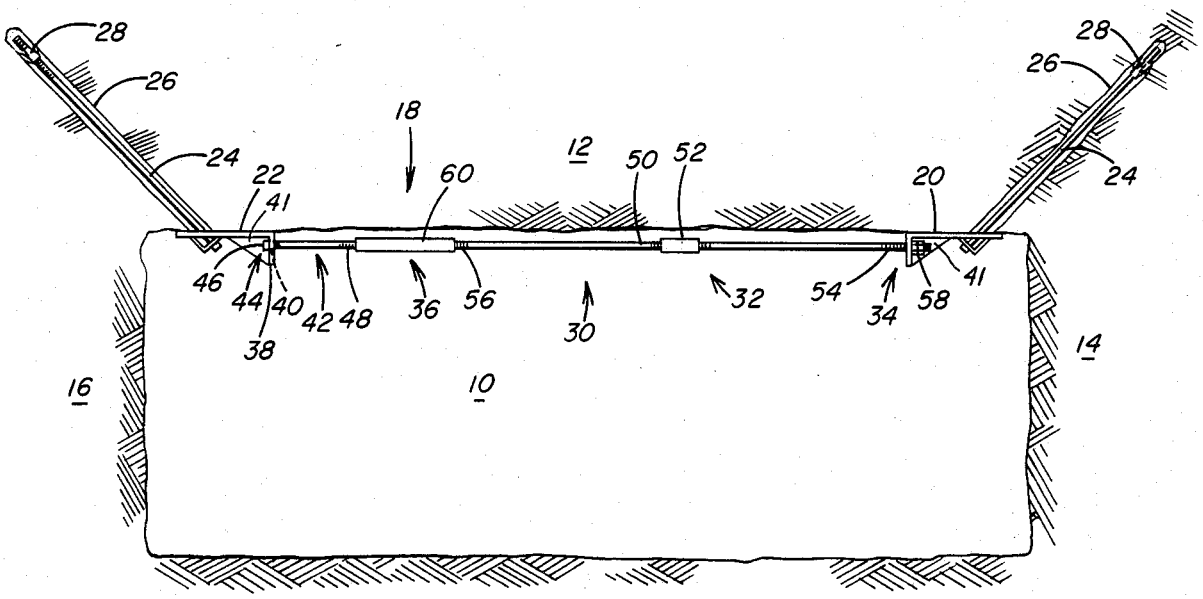
FIG. 1 is an elevational view of a section of a mine or the like including a preferred embodiment of an improved roof support system of the present invention.
Figure 2:
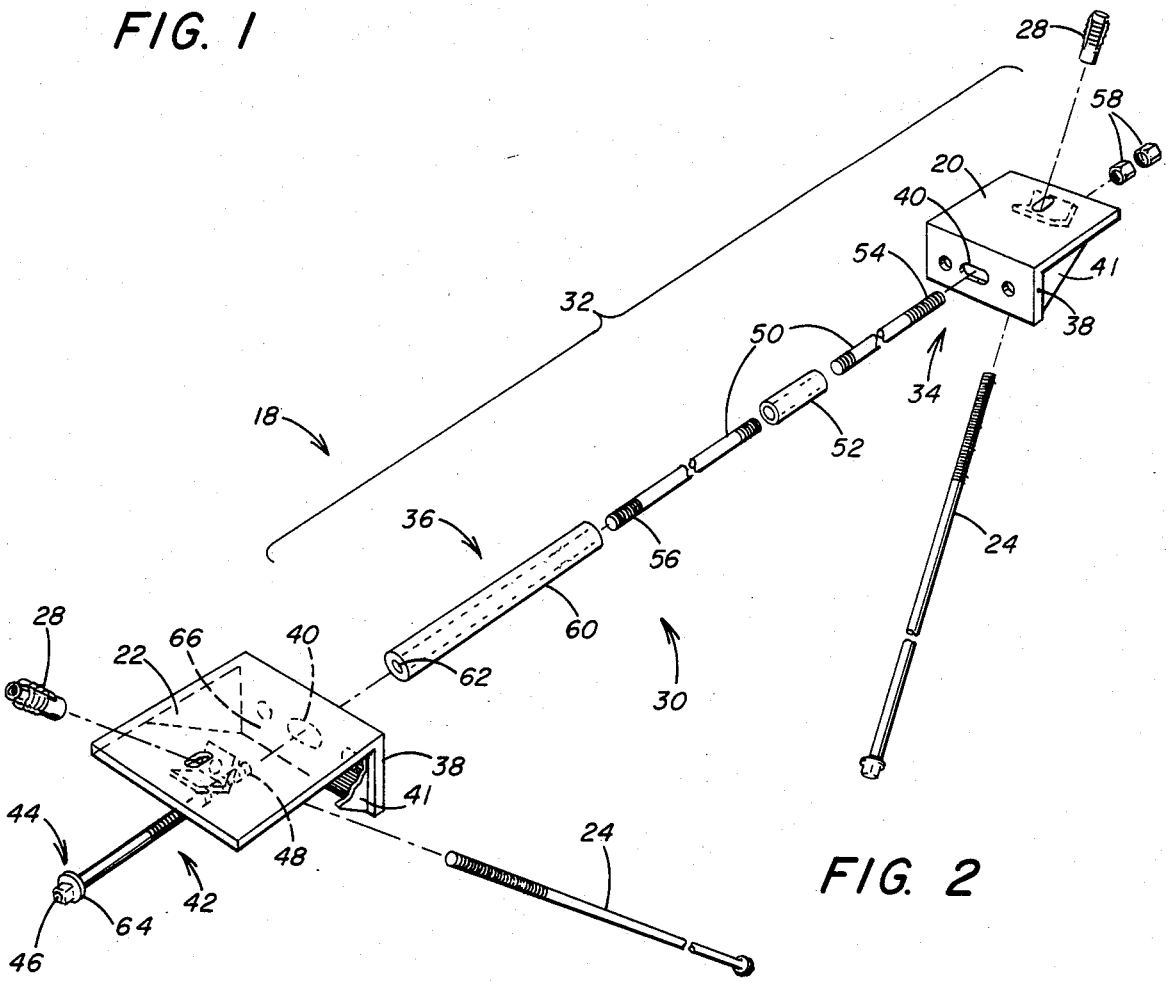
FIG. 2 is an exploded view of the major components of the preferred embodiment as shown in FIG. 1.

As seen in FIG. 1, a typical mine shaft or opening 10 would include a roof 12 between opposing ribs 14, 16. An improved roof support system 18 includes various features of the invention and is of the type which includes a pair of plates 20, 22 which are secured to the roof 12 by inclined cords in the form of roof bolts 24. The roof bolts 24 are installed through bores 26 in a conventional manner with associated anchoring devices 28 being fully installed at the terminal end of each bore 26 to retain the bolt 24 therein and allow tension to be created thereby. It will be seen that any number of such anchoring means could be employed without affecting the specific features of the improvement represented by the present invention. For example, the roof bolts may utilize mechanical, resin or a combination of mechanical and resin bonding to insure proper support of the plates 20, 22 while allowing proper tension to be applied thereto to produce the overall desire resulting forces on the roof 12.

A horizontal, transverse reinforcing member 30 extends between the plates 20, 22. The preferred reinforcing member 30 includes a first rod means 32 having a first end 34 secured to the plate 20 and a second end 36 extending toward the plate 22. The preferred plate 22 includes a vertically depending portion 38 thereof which has a transversely extending opening 40 therethrough. Reinforcing members 41 may be provided at each side of the vertically depending portion 38 to provide overall strength to each of the plates 20, 22 even though only one such member 41 may be shown in some of the Figures to simplify the drawings. The reinforcing member 30 also includes a second rod means 42 which has a first end 44 including an enlarged head 46, preferably in the form of a bolt head with torque applying surfaces thereon. The first end 44 is located against the vertical portion 38 of the plate 22 as the second rod means 42 extends through the opening 40 with a second end 48 thereof extending toward the plate 20.

Although the particular components provided could be altered while still being within the scope of the invention, it should initially be recognized that the second end 36 of the first rod 32 and the second end 48 of the second rod 42 should include mating threaded means thereon for coupling the first rod means 32 and second rod means 42 together to form the preferred reinforcing member 30. When so threaded for coupling, the reinforcing member 30 will be capable of producing tension between the plates 20 and 22 which tension may be varied by rotating the enlarged head 46 of the second rod means 42 relative to the first rod means 32. As seen in FIGS. 2 through 5, there are various components of the preferred reinforcing member 30 which are simple to provide and install and are easily adaptable for roof support systems in different locations requiring different transverse distances between the plates 20, 22.

Accordingly, when a plurality of the plates 20, 22 are installed for a series of roof support systems, the overall length of the desired reinforcing members 30 can be determined. Although other configurations could be employed in the preferred reinforcing member 30, it is desirable for the first rod member 32 to be longer and extend across the primary length between the plates 20, 22 and a shorter second rod member 42 to be employed. As a result, the first rod member 32 can include a primary rod portion 50 which is either integrally formed or made to a predetermined length by a coupling element 52 centrally mounted therein. More significantly, the primary rod portion 50 will in the preferred first rod means 32 include a first threaded end 54 and a second threaded end 56. The threaded end 54 will be joined to the plate 20 through a similar hole 40 in a vertical portion 38 by retaining a nut means 58. The preferred nut means 58 may include two nuts in order to insure that they are properly locked in position on the threaded end 54. The second end 36 of the first rod means 32 will preferably include a sleeve coupling 60 which has a longitudinally extending threaded bore 62 therethrough. The sleeve coupling 60 is partially mounted on the threaded end 56 of the primary rod portion 50 while insuring that a portion of the threaded bore 62 extends outwardly therefrom.

The shorter, preferred second rod means 42 is a bolt having a bolt head 46 thereon which can be utilized in conjunction with a washer 64. The second end 48 of the bolt 42 is threaded to mate with the threaded bore 62 of the sleeve coupling 60 of the first rod means 32.

As thus described, it should be clear that a mining crew would be capable of providing a series of reinforcing members 30 by utilizing a bundle of first rod means 32 which are preassembled the proper length and a second bundle of bolts which would be employed as the second rod means 42.

Figure 3:
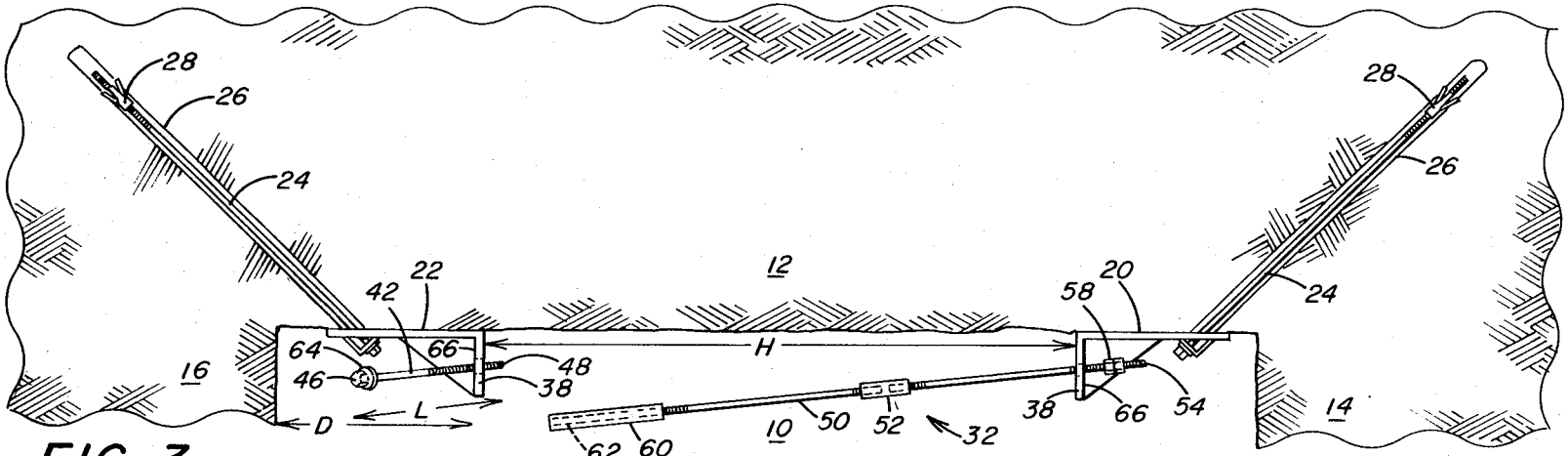
FIG. 3 is a view like that shown in FIG. 1 as the horizontal, transverse reinforcing member of the preferred embodiment as it is being installed.

As seen in FIG. 3, after the plates 20, 22 are fully installed, the first rod means 32 can be installed by extending the threaded end 54 through the hole 40 of plate 20 and installing the nut means 58. Installed in this manner, the sleeve coupling 60 would extend toward the plate 22. The second rod means 42 in the preferred form of a bolt is installed with the head 46 and washer 64 of the bolt against a force bearing surface 66 of the vertical portion 38 of the plate 22 with the threaded end 48 capable of being threadably engaged with and received within the threaded bore 62 of the sleeve coupling 60 of the first rod means 32. However, as seen in FIG. 3, it should be noted that in most installations of this type, the plates 20, 22 are secured to the roof 12 with the force bearing surface 66 of the vertical portion 38 thereof a predetermined distance D from the adjacent corresponding rib 14, 16 of the mine. The predetermined distance D is significantly less than a horizontal distance H between the plates 20, 22. Accordingly, since, as it will be seen later, it is desirable for the second rod means 42 to have an integrally formed enlarged head 46 thereon, the overall length L of the second rod means 42 should be less than the predetermined distance D to allow for easy installation of the second rod means 42 in the transveresly extending opening 40 as it is positioned between the force bearing surface 66 and the adjacent rib 16. Although there may be some alternative configurations for providing horizontal, transverse reinforcing members which employ first rod means and second rod means which are approximately the same overall length, it can be seen that the preferred configuration in the form of first rod means 32 as described hereinabove and second rod means 42 as described hereinabove can be conveniently employed to produce a horizontal reinforcing member 30 which extends across plates 20, 22 with varying horizontal distances H therebetween but is simple to assemble and install.

Figure 4:
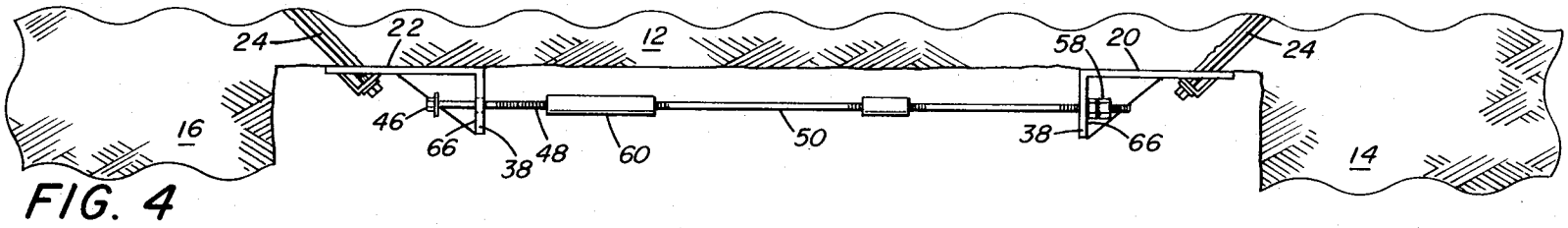
FIG. 4 is a view as shown in FIG. 3 with the horizontal, transverse reinforcing member partially installed.
Figure 5:
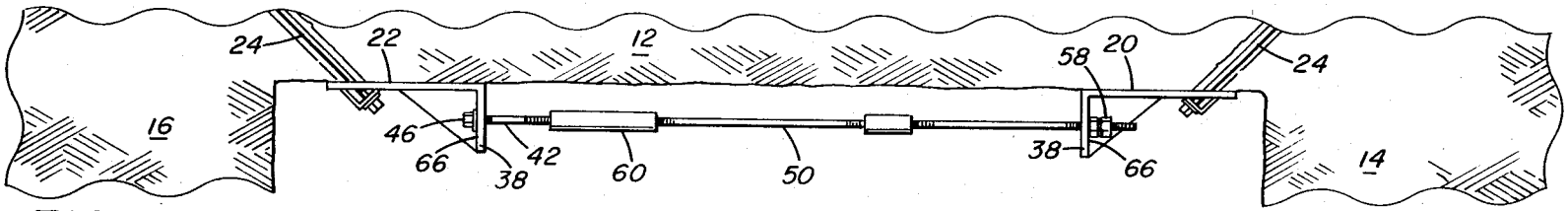
FIG. 5 is a view like that shown in FIG. 4 with the horizontal, transverse reinforcing member in position for final tensioning.

Referring to FIG. 4, with both the first rod means 32 and the second rod means 42 installed as described hereinabove, the second rod means 32 can be threadably installed by hand within the preferred sleeve coupling 60. As seen in FIG. 5, this hand installation can continue to produce insertion of the threaded end 48 into the threaded bore 62 until the enlarged head 46 is brought into contact with the force bearing surface 66 of the plate 22. At the same time, the nut means 58 of the first rod means 32 will be brought into contact with the force bearing surface 66 on the plate 20. With the preferred reinforcing member 30 initially installed in this manner, it has been found that frictional forces created between the nut means 58 and the force bearing surface 66 of the plate 20 will be sufficient to allow further, forced rotation of the enlarged head 46 to produce relative rotation between the first rod means 32 and the second rod means 42 while the first rod means 32 remains stationary without any rotation relative to the plate 20 to which it is secured.

Although the preferred improved roof support system 18 as described for initial installation may appear to be similiar to the prior art devices as disclosed in the patents mentioned hereinabove, there are features associated therewith for providing tension on the plates 20, 22 in a more convenient and effective manner. Specifically, while the prior devices as discussed hereinabove primary utilized either turn buckle configurations or adjusting nuts on threaded bolt ends extending therethrough, the preferred configuration of the improved roof support system 18 employs an enlarged head 46 which remains located against a predetermined force bearing surface 66 throughout adjustment to produce the desired tension on the plates 20, 22. Since the head 46 is portions of the second rod means 42, there is no bolt end or rod section located near the working surfaces which has heretofore interferred with and complicated efforts to provide a means for power torquing the reinforcing member.

Figure 6:
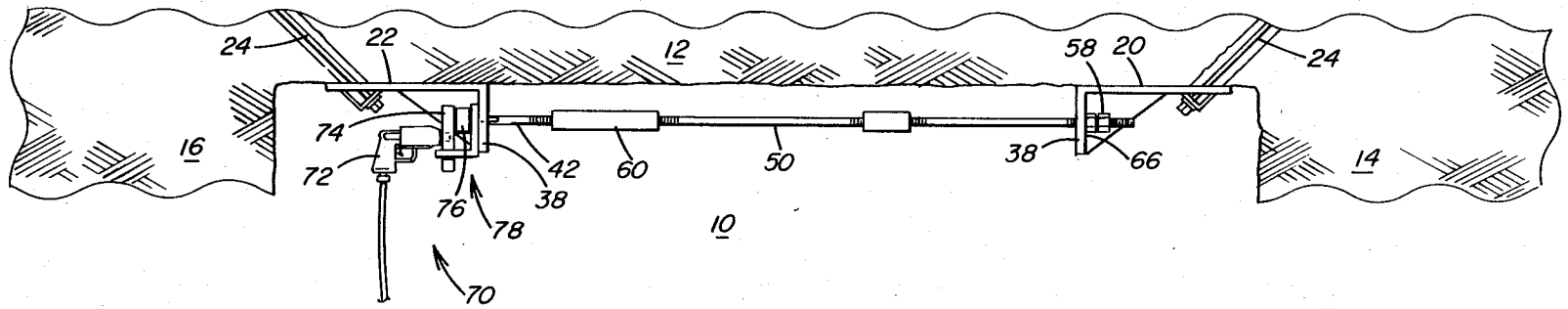
FIG. 6 is a view of the preferred embodiment as seen in FIG. 5 with a preferred tool for providing tension to the roof support system demonstrating its position when tension is being created.
Figure 7:
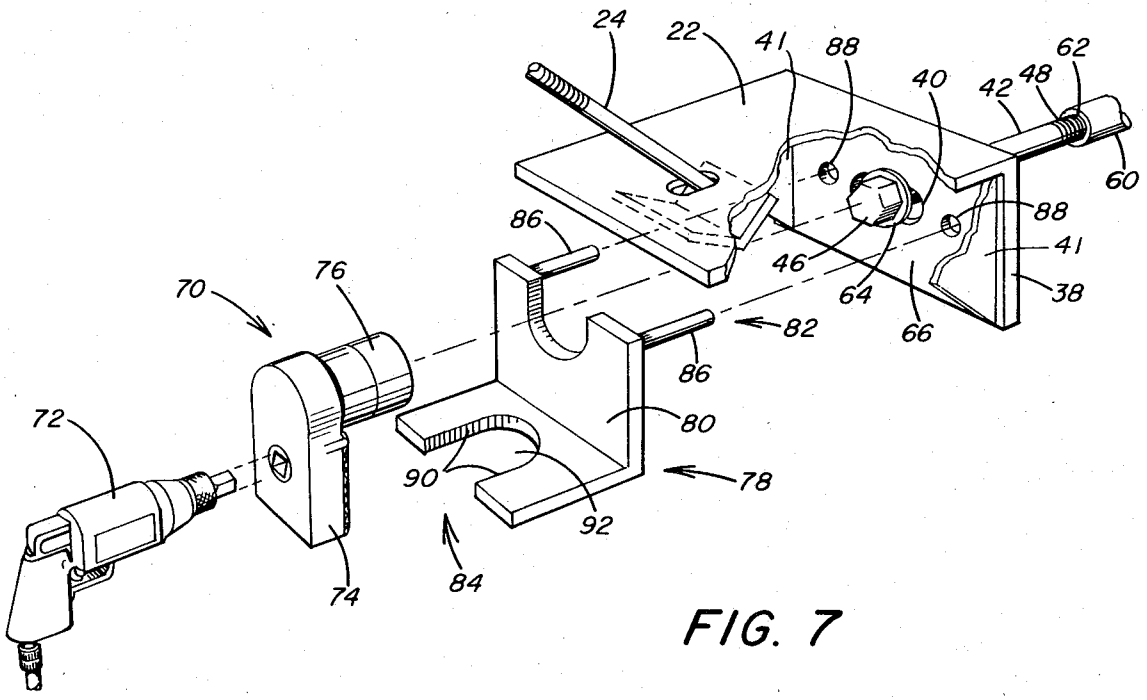
FIG. 7 is an exploded, perspective view of the preferred tool of the invention showing its relationship with other components of the preferred improved roof support system.

As seen in FIGS. 6 and 7, the preferred means for power torquing the reinforcing member 30 and creating desired tension between the plates 20, 22 is a preferred tool 70. Such a tool 70 must include a source of power and a means for converting this source of power to a rotating torque applying element. It has been found that presurized hydraulic fluid can provide such a source of power and a hydraulic motor can be utilized as a means for converting the source of power to the proper output. In the preferred tool 70 a hydraulic drill 72 is joined to a speed reducing, force multiplier 74 to provide the output shaft with an output fitting 76 thereon. The output fitting 76 can include a conventional socket fitting designed to mate with the conventional bolt head which is utilized in the preferred second rod means 42.

However, because of the forces required for properly applying sufficient torque to generate the desired tension between the plates 20, 22, a means must be provided for stabilizing the hydraulic drill 72 and force multiplier 74 to prevent relative rotation thereof with respect to the plate 22 during rotation of the bolt head by the socket fitting. In the preferred tool 70, this is provided by a stabilizing means 78 including a bracket 80 which extends between the force multiplier 74 and plate 22. The preferred bracket 80 includes first abutting elements 82 at one end thereof to make abutting contact with the plate 22 and second abutting elements 84 at the other end thereof to make abutting contact with the force multiplier 74. Although any number of configurations could be employed to accomplish such a feature, the preferred bracket 80 has first abutting elements 82 in the form of a pair of rods 86 which extend through corresponding holes 88 in the vertical portion 38 of the plate 22. The second abutting elements 84 include the sides 90 of a notch 92 which receives a major body portion of the force multiplier 74 therein when the tool 70 is being employed to produce rotation of the enlarged head 46.

It has been found, for example, that a torque of about 200 foot pounds can be applied to an enlarged head 46 to produce the desired tension between typical plates 20, 22. In one configuration, the force multiplier 74 will reduce the speed while multiplying the output force therefrom at a ratio of about three to one. Accordingly, it has been found that a hydraulic drill 72 can be preset to operate at a maximum output force of about 60 to 70 foot pounds to produce the desired torque needed to insure proper tension between the plates 20, 22. Such a configuration allows for rapid, automatic torsion to be applied to the reinforcing member 30 insuring that the desired tension between plates 20, 22 is provided during initial installation of the preferred roof support system 18.

It should be recognized that alterations could be made to the preferred embodiment as described hereinabove without departing from the spirit of the invention as claimed. Specifically, although it is preferred for plates 20, 22 to be of the same design for ease of installation and inventory purposes, one or the other could be altered to specifically accommodate a different form of first rod means or second rod means while still being within the scope of the invention. Similarly, although the use of inclined cords to secure the plates 20, 22 is taught and would primary be employed, it should be recognized that there may be other types of roof support systems which employ such plates and utilize a tension applying reinforcing member therebetween which such reinforcing member could fall within the scope of the present invention. Still further, although the preferred tool for producing the desired tension on the roof support plates is taught herein, any number of any other types of tools as defined in the claims could be employed.

We claim:

1. An improved roof support system for a mine or the like of the type which includes a pair of plates secured to a roof of said mine at opposite sides thereof adjacent opposing ribs of said mine and a horizontal, transverse reinforcing member extending between said pair of said plates, said improvement comprising:

said reinforcing member including a first rod means having a first end secured to a first of said pair of said plates and a second end extending toward a second of said pair of said plates;

said second plate having a vertical portion thereof with a transversely extending opening therethrough;

said reinforcing member including a second rod means having a first end with an integral enlarged head portion with torque applying surfaces thereon, said first end being located in abutting relation with said vertical portion of said second plate with said second rod means extending through said opening with a second end thereof extending toward said first plate; and said second ends of said first and said second rod means including mating threaded means thereon for coupling said first and said second rod means together to form said reinforcing member which is capable of producing tension between said first and said second plates so that said tension may be varied by rotation of said enlarged head of said second rod means relative to said first rod means.

2. The improved roof support system as set forth in claim 1, wherein said second plate is secured to said roof with said vertical portion thereof a predetermined distance from an adjacent rib of said mine, said predetermined distance being significantly less than a horizontal distance between said first and said second plates, said second rod means having an overall length less than said predetermined distance whereby said second rod means can be installed in said transversely extending opening of said vertical portion of said second plate when said second plate is secured to said roof.

3. The improved roof support system as set forth in claim 1, wherein said first rod means includes means for preventing relative rotation between said first rod means and said first plate when tension is being produced between said first and said second plates.

4. The improved roof support system as set forth in claim 3, wherein said means for preventing relative rotation includes frictional contact between said first end of said first rod means and said first plate.

5. The improved roof support system as set forth in claim 1, wherein said first plate has a vertical portion thereof with a transversely extending opening therethrough.

6. The improved roof support system as set forth in claim 5, wherein said first and said second plates are of substantially the same configuration.

7. The improved roof support system as set forth in claim 5, wherein said first rod means includes an elongated rod with threaded regions at the opposite ends thereof, said first end of said first rod means includes a nut threadably secured on one of said threaded regions of said rod as said rod extends through said opening in said vertical portion of said first plate, and said second end of said first rod means includes a sleeve member with a longitudinally extending threaded bore therethrough, said sleeve being threadedly secured to the other of said threaded regions of said rod.

8. The improved roof support system as set forth in claim 7, wherein said second rod means includes a bolt having a head thereon at said first end thereof and a threaded region at said second end thereof, said threaded region of said second rod means threadedly secured in said threaded bore of said sleeve.

9. A method of supporting a roof of a mine or the like comprising the steps of;

securing a pair of roof supporting plates at opposite sides of said roof adjacent opposing ribs of said mine, each of said plates having a vertically extending force bearing surface thereon;

providing a first rod means having securing means at a first end thereof and a threaded coupling at a second end thereof;

providing a second rod means having an enlarged integral head portion with torque applying surfaces thereon at a first end thereof and a threaded region at a second end thereof which is capable of being threadably mated with said threaded coupling of said first rod means;

installing said first rod means with said securing means of said first end against said force bearing surface of a first of said pair of said plates and said second end extending toward a second of said pair of said plates;

installing said second rod means with said enlarged head portion against said force bearng surface of said second plate;

threadedly engaging said second rod means to said threaded coupling on said first rod means; and producing tension between said first and said second plates by rotating said enlarged head portion of said second rod means relative to said first rod means to move said threaded region of said second end of said second rod means longitudinally into said threaded coupling of said first rod means.

10. The method as set forth in claim 9, wherein said step of producing tension between said first and said second plates is accomplished by rotating said head portion of said second rod means while said first rod means is prevented from rotation relative to said first plate.

11. The method as set forth in claim 9, wherein said step of providing tension between said first plate and said second plate produces frictional contact between said securing means of said first rod means and said force bearing surface of said first plate to prevent relative rotation therebetween.

12. The method as set forth in claim 9, wherein said first plate includes a transversely extending opening in said force bearing surface, said securing means includes a threaded end and a nut threaded thereon, and said step of installing said first rod means includes extending said threaded end through said opening of said first plate and installing said nut thereon between said adjacent rib and said force bearing surface of said first plate.

13. The method as set forth in claim 9, wherein said second plate includes a transversely extending opening in said force bearing surface and said step of installing said second rod means includes inserting said threaded region of said second end through said opening between said adjacent rib and said forced bearing surface until said enlarged integral head portion is located against said force bearing surface.

14. The method as set forth in claim 1, wherein said enlarged head portion includes an integral bolt head and washer with said washer being installed between said bolt head and said force bearing surface during the installing of said second rod means.

* * * * *